US008325929B2

(12) United States Patent
Koppens et al.

(10) Patent No.: US 8,325,929 B2
(45) Date of Patent: Dec. 4, 2012

(54) BINAURAL RENDERING OF A MULTI-CHANNEL AUDIO SIGNAL

(75) Inventors: Jeroen Koppens, Nederweert (NL); Harald Mundt, Erlangen (DE); Leonid Terentiev, Erlangen (DE); Cornelia Falch, Nuremberg (DE); Johannes Hilpert, Nuremberg (DE); Oliver Hellmuth, Erlangen (DE); Lars Villemoes, Jaerfaella (SE); Jan Plogsties, Erlangen (DE); Jeroen Breebaart, Eindhoven (NL); Jonas Engdegard, Stockhom (SE)

(73) Assignees: Fraunhofer-Gesellschaft zur Foerderung der Angewandten Forschung e.V., Munich (DE); Koninklijke Philips Electronics, Eindhoven (NL); Dolby Sweden AG, Stockholm (SE)

( * ) Notice: Subject to any disclaimer, the term of this patent is extended or adjusted under 35 U.S.C. 154(b) by 8 days.

(21) Appl. No.: 13/080,685

(22) Filed: Apr. 6, 2011

(65) Prior Publication Data

US 2011/0264456 A1 Oct. 27, 2011

Related U.S. Application Data

(63) Continuation of application No. PCT/EP2009/006955, filed on Sep. 25, 2009.

(60) Provisional application No. 61/103,303, filed on Oct. 7, 2008.

(30) Foreign Application Priority Data

May 15, 2009 (EP) ..... 09006598

(51) Int. Cl.
*H04R 5/00* (2006.01)

(52) U.S. Cl. ..... 381/1; 381/17

(58) Field of Classification Search ..... 381/1, 2, 381/17, 18

See application file for complete search history.

(56) References Cited

U.S. PATENT DOCUMENTS

2007/0160219 A1* 7/2007 Jakka et al. ..... 381/22
2007/0223749 A1* 9/2007 Kim et al. ..... 381/309
2009/0043591 A1* 2/2009 Breebaart et al. ..... 704/500

(Continued)

FOREIGN PATENT DOCUMENTS

WO 2007/078254 A2 7/2007

(Continued)

OTHER PUBLICATIONS

Official Communication issued in International Patent Application No. PCT/EP2009/006955, mailed on Jan. 27, 2010.

(Continued)

*Primary Examiner* — Samuel G Neway
(74) *Attorney, Agent, or Firm* — Keating & Bennett, LLP

(57) ABSTRACT

Binaural rendering a multi-channel audio signal into a binaural output signal is described. The multi-channel audio signal has a stereo downmix signal into which a plurality of audio signals are downmixed, and side information having a downmix information, as well as object level information of the plurality of audio signals and inter-object cross correlation information. Based on a first rendering prescription, a preliminary binaural signal is computed from the first and second channels of the stereo downmix signal. A decorrelated signal is generated as an perceptual equivalent to a mono downmix of the first and second channels of the stereo downmix signal being, however, decorrelated to the mono downmix. Depending on a second rendering prescription, a corrective binaural signal is computed from the decorrelated signal and the preliminary binaural signal is mixed with the corrective binaural signal to obtain the binaural output signal.

11 Claims, 6 Drawing Sheets

U.S. PATENT DOCUMENTS

| | | | | |
|---|---|---|---|---|
| 2009/0129601 | A1* | 5/2009 | Ojala et al. | 381/1 |
| 2010/0094631 | A1* | 4/2010 | Engdegard et al. | 704/258 |
| 2010/0246832 | A1* | 9/2010 | Villemoes et al. | 381/17 |

FOREIGN PATENT DOCUMENTS

| | | | |
|---|---|---|---|
| WO | 2007/083952 | A1 | 7/2007 |
| WO | 2008/069593 | A1 | 6/2008 |

OTHER PUBLICATIONS

"Information Technology—MPEG Audio Technologies—Part 2: Spatial Audio Object Coding (SAOC)", 85th MPEG Meeting, Jul. 2008, 138 pages.

"Method for the Subjective Assessment of Intermediate Quality Level of Coding Systems", pp. 1-18, Oct. 1999.

"Information Technology—MPEG Audio Technologies—Part 1: MPEG Surround", ISO/IEC FDIS 23003-1:2006, Jul. 21, 2006, 289 pages.

"Final Spatial Audio Object Coding Evaluation Procedures and Criterion", ISO/IEC JTC1/SC29/WG11, San Jose, Apr. 2007, pp. 1-14.

Breebaart et al., "Spatial Audio Processing MPEG Surround and Other Applications", John Wiley & Sons, Ltd., pp. 1-209.

Breebaart et al., "Multi-Channel Goes Mobile: MPEG Surround Binaural Rendering", AES 29th International Conference, Seoul, Korea, Sep. 2-4, 2006, pp. 1-13.

Engdegard et al., "Spatial Audio Object Coding (SAOC)—The Upcoming MPEG Standard on Parametric Object Based Audio Coding", AES 124th Convention Paper 7377, Amsterdam, The Netherlands, May 2008, 16 pages.

* cited by examiner

BINAURAL RENDERING OF A MULTI-CHANNEL AUDIO SIGNAL

CROSS-REFERENCE TO RELATED APPLICATIONS

This application is a continuation of copending International Application No. PCT/EP2009/006955, filed Sep. 25, 2009, which is incorporated herein by reference in its entirety, and additionally claims priority from European Application No. EP 09006598.8, filed May 15, 2009 and U.S. Provisional Application No. 61/103,303, filed Oct. 7, 2008, which are all incorporated herein by reference in their entirety.

BACKGROUND OF THE INVENTION

The present application relates to binaural rendering of a multi-channel audio signal.

Many audio encoding algorithms have been proposed in order to effectively encode or compress audio data of one channel, i.e., mono audio signals. Using psychoacoustics, audio samples are appropriately scaled, quantized or even set to zero in order to remove irrelevancy from, for example, the PCM coded audio signal. Redundancy removal is also performed.

As a further step, the similarity between the left and right channel of stereo audio signals has been exploited in order to effectively encode/compress stereo audio signals.

However, upcoming applications pose further demands on audio coding algorithms. For example, in teleconferencing, computer games, music performance and the like, several audio signals which are partially or even completely uncorrelated have to be transmitted in parallel. In order to keep the necessary bit rate for encoding these audio signals low enough in order to be compatible to low-bit rate transmission applications, recently, audio codecs have been proposed which downmix the multiple input audio signals into a downmix signal, such as a stereo or even mono downmix signal. For example, the MPEG Surround standard downmixes the input channels into the downmix signal in a manner prescribed by the standard. The downmixing is performed by use of so-called $OTT^{-1}$ and $TTT^{-1}$ boxes for downmixing two signals into one and three signals into two, respectively. In order to downmix more than three signals, a hierarchic structure of these boxes is used. Each $OTT^{-1}$ box outputs, besides the mono downmix signal, channel level differences between the two input channels, as well as inter-channel coherence/cross-correlation parameters representing the coherence or cross-correlation between the two input channels. The parameters are output along with the downmix signal of the MPEG Surround coder within the MPEG Surround data stream. Similarly, each $TTT^{-1}$ box transmits channel prediction coefficients enabling recovering the three input channels from the resulting stereo downmix signal. The channel prediction coefficients are also transmitted as side information within the MPEG Surround data stream. The MPEG Surround decoder upmixes the downmix signal by use of the transmitted side information and recovers, the original channels input into the MPEG Surround encoder.

However, MPEG Surround, unfortunately, does not fulfill all requirements posed by many applications. For example, the MPEG Surround decoder is dedicated for upmixing the downmix signal of the MPEG Surround encoder such that the input channels of the MPEG Surround encoder are recovered as they are. In other words, the MPEG Surround data stream is dedicated to be played back by use of the loudspeaker configuration having been used for encoding, or by typical configurations like stereo.

However, according to some applications, it would be favorable if the loudspeaker configuration could be changed at the decoder's side freely.

In order to address the latter needs, the spatial audio object coding (SAOC) standard is currently designed. Each channel is treated as an individual object, and all objects are downmixed into a downmix signal. That is, the objects are handled as audio signals being independent from each other without adhering to any specific loudspeaker configuration but with the ability to place the (virtual) loudspeakers at the decoder's side arbitrarily. The individual objects may comprise individual sound sources as e.g. instruments or vocal tracks. Differing from the MPEG Surround decoder, the SAOC decoder is free to individually upmix the downmix signal to replay the individual objects onto any loudspeaker configuration. In order to enable the SAOC decoder to recover the individual objects having been encoded into the SAOC data stream, object level differences and, for objects forming together a stereo (or multi-channel) signal, inter-object cross correlation parameters are transmitted as side information within the SAOC bitstream. Besides this, the SAOC decoder/transcoder is provided with information revealing how the individual objects have been downmixed into the downmix signal. Thus, on the decoder's side, it is possible to recover the individual SAOC channels and to render these signals onto any loudspeaker configuration by utilizing user-controlled rendering information.

However, although the afore-mentioned codecs, i.e. MPEG Surround and SAOC, are able to transmit and render multi-channel audio content onto loudspeaker configurations having more than two speakers, the increasing interest in headphones as audio reproduction system necessitates that these codecs are also able to render the audio content onto headphones. In contrast to loudspeaker playback, stereo audio content reproduced over headphones is perceived inside the head. The absence of the effect of the acoustical pathway from sources at certain physical positions to the eardrums causes the spatial image to sound unnatural since the cues that determine the perceived azimuth, elevation and distance of a sound source are essentially missing or very inaccurate. Thus, to resolve the unnatural sound stage caused by inaccurate or absent sound source localization cues on headphones, various techniques have been proposed to simulate a virtual loudspeaker setup. The idea is to superimpose sound source localization cues onto each loudspeaker signal. This is achieved by filtering audio signals with so-called head-related transfer functions (HRTFs) or binaural room impulse responses (BRIRs) if room acoustic properties are included in these measurement data. However, filtering each loudspeaker signal with the just-mentioned functions would necessitate a significantly higher amount of computation power at the decoder/reproduction side. In particular, rendering the multi-channel audio signal onto the "virtual" loudspeaker locations would have to be performed first wherein, then, each loudspeaker signal thus obtained is filtered with the respective transfer function or impulse response to obtain the left and right channel of the binaural output signal. Even worse: the thus obtained binaural output signal would have a poor audio quality due to the fact that in order to achieve the virtual loudspeaker signals, a relatively large amount of synthetic decorrelation signals would have to be mixed into the upmixed signals in order to compensate for the correlation between originally uncorrelated audio input signals, the correlation resulting from downmixing the plurality of audio input signals into the downmix signal.

In the current version of the SAOC codec, the SAOC parameters within the side information allow the user-interactive spatial rendering of the audio objects using any playback setup with, in principle, including headphones. Binaural rendering to headphones allows spatial control of virtual object positions in 3D space using head-related transfer function (HRTF) parameters. For example, binaural rendering in SAOC could be realized by restricting this case to the mono downmix SAOC case where the input signals are mixed into the mono channel equally. Unfortunately, mono downmix necessitates all audio signals to be mixed into one common mono downmix signal so that the original correlation properties between the original audio signals are maximally lost and therefore, the rendering quality of the binaural rendering output signal is non-optimal.

SUMMARY

According to an embodiment, an apparatus for binaural rendering a multi-channel audio signal into a binaural output signal, the multi-channel audio signal having a stereo downmix signal into which a plurality of audio signals are downmixed, and side information having a downmix information indicating, for each audio signal, to what extent the respective audio signal has been mixed into a first channel and a second channel of the stereo downmix signal, respectively, as well as object level information of the plurality of audio signals and inter-object cross correlation information describing similarities between pairs of audio signals of the plurality of audio signals, may be configured to: compute, based on a first rendering prescription depending on the inter-object cross correlation information, the object level information, the downmix information, rendering information relating each audio signal to a virtual speaker position and HRTF parameters, a preliminary binaural signal from the first and second channels of the stereo downmix signal; generate a decorrelated signal as an perceptual equivalent to a mono downmix of the first and second channels of the stereo downmix signal being, however, decorrelated to the mono downmix; compute, depending on a second rendering prescription depending on the inter-object cross correlation information, the object level information, the downmix information, the rendering information and the HRTF parameters, a corrective binaural signal from the decorrelated signal; and mix the preliminary binaural signal with the corrective binaural signal to obtain the binaural output signal.

According to another embodiment, a method for binaural rendering a multi-channel audio signal into a binaural output signal, the multi-channel audio signal having a stereo downmix signal into which a plurality of audio signals are downmixed, and side information having a downmix information indicating, for each audio signal, to what extent the respective audio signal has been mixed into a first channel and a second channel of the stereo downmix signal, respectively, as well as object level information of the plurality of audio signals and inter-object cross correlation information describing similarities between pairs of audio signals of the plurality of audio signals, may have the steps of: computing, based on a first rendering prescription depending on the inter-object cross correlation information, the object level information, the downmix information, rendering information relating each audio signal to a virtual speaker position and HRTF parameters, a preliminary binaural signal from the first and second channels of the stereo downmix signal; generating a decorrelated signal as an perceptual equivalent to a mono downmix of the first and second channels of the stereo downmix signal being, however, decorrelated to the mono downmix; computing, depending on a second rendering prescription depending on the inter-object cross correlation information, the object level information, the downmix information, the rendering information and the HRTF parameters, a corrective binaural signal from the decorrelated signal; and mixing the preliminary binaural signal with the corrective binaural signal to obtain the binaural output signal.

Another embodiment may have a computer program having instructions for performing, when running on a computer, a method for binaural rendering a multi-channel audio signal into a binaural output signal as mentioned above.

One of the basic ideas underlying the present invention is that starting binaural rendering of a multi-channel audio signal from a stereo downmix signal is advantageous over starting binaural rendering of the multi-channel audio signal from a mono downmix signal thereof in that, due to the fact that few objects are present in the individual channels of the stereo downmix signal, the amount of decorrelation between the individual audio signals is better preserved, and in that the possibility to choose between the two channels of the stereo downmix signal at the encoder side enables that the correlation properties between audio signals in different downmix channels is partially preserved. In other words, due to the encoder downmix, the inter-object coherences are degraded which has to be accounted for at the decoding side where the inter-channel coherence of the binaural output signal is an important measure for the perception of virtual sound source width, but using stereo downmix instead of mono downmix reduces the amount of degrading so that the restoration/generation of the proper amount of inter-channel coherence by binaural rendering the stereo downmix signal achieves better quality.

A further main idea of the present application is that the afore-mentioned ICC (ICC=inter-channel coherence) control may be achieved by means of a decorrelated signal forming a perceptual equivalent to a mono downmix of the downmix channels of the stereo downmix signal with, however, being decorrelated to the mono downmix. Thus, while the use of a stereo downmix signal instead of a mono downmix signal preserves some of the correlation properties of the plurality of audio signals, which would have been lost when using a mono downmix signal, the binaural rendering may be based on a decorrelated signal being representative for both, the first and the second downmix channel, thereby reducing the number of decorrelations or synthetic signal processing compared to separately decorrelating each stereo downmix channel.

BRIEF DESCRIPTION OF THE DRAWINGS

Referring to the figures, embodiments of the present application are described in more detail. Among these figures.

DETAILED DESCRIPTION OF THE INVENTION

Before embodiments of the present invention are described in more detail below, the SAOC codec and the SAOC parameters transmitted in an SAOC bit stream are presented in order to ease the understanding of the specific embodiments outlined in further detail below.

Figure 1:
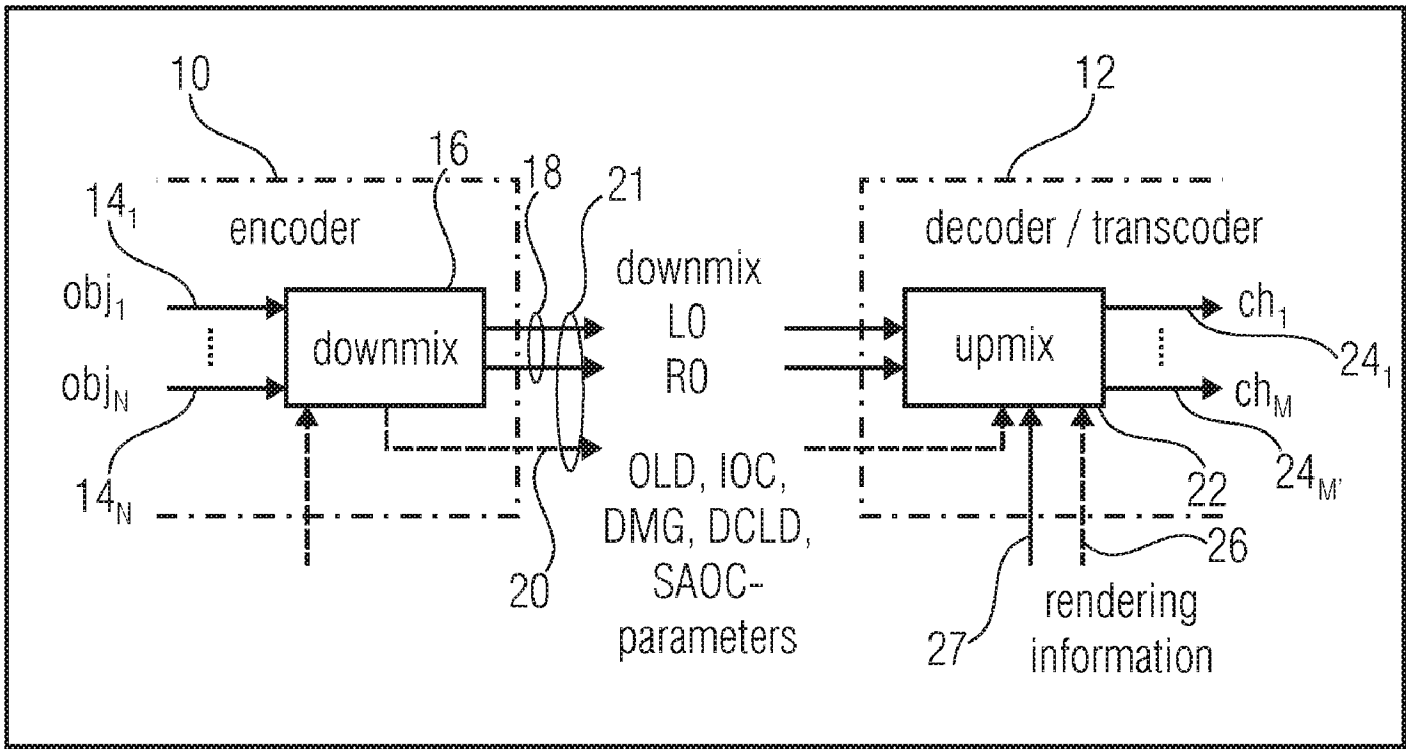
FIG. 1 shows a block diagram of an SAOC encoder/decoder arrangement in which the embodiments of the present invention may be implemented.

FIG. 1 shows a general arrangement of an SAOC encoder 10 and an SAOC decoder 12. The SAOC encoder 10 receives as an input N objects, i.e., audio signals $\mathbf{14}_1$ to $\mathbf{14}_N$. In particular, the encoder 10 comprises a downmixer 16 which receives the audio signals $\mathbf{14}_1$ to $\mathbf{14}_N$ and downmixes same to a downmix signal 18. In FIG. 1, the downmix signal is exemplarily shown as a stereo downmix signal. However, the encoder 10 and decoder 12 may be able to operate in a mono mode as well in which case the downmix signal would be a mono downmix signal. The following description, however, concentrates on the stereo downmix case. The channels of the stereo downmix signal 18 are denoted LO and RO.

In order to enable the SAOC decoder 12 to recover the individual objects $\mathbf{14}_1$ to $\mathbf{14}_N$, downmixer 16 provides the SAOC decoder 12 with side information including SAOC-parameters including object level differences (OLD), inter-object cross correlation parameters (IOC), downmix gains values (DMG) and downmix channel level differences (DCLD). The side information 20 including the SAOC-parameters, along with the downmix signal 18, forms the SAOC output data stream 21 received by the SAOC decoder 12.

The SAOC decoder 12 comprises an upmixing 22 which receives the downmix signal 18 as well as the side information 20 in order to recover and render the audio signals $\mathbf{14}_1$ and $\mathbf{14}_N$ onto any user-selected set of channels $\mathbf{24}_1$ to $\mathbf{24}_{M'}$, with the rendering being prescribed by rendering information 26 input into SAOC decoder 12 as well as HRTF parameters 27 the meaning of which is described in more detail below. The following description concentrates on binaural rendering, where M'=2 and, the output signal is especially dedicated for headphones reproduction, although decoding 12 may be able to render onto other (non-binaural) loudspeaker configuration as well, depending on commands within the user input 26.

The audio signals $\mathbf{14}_1$ to $\mathbf{14}_N$ may be input into the downmixer 16 in any coding domain, such as, for example, in time or spectral domain. In case, the audio signals $\mathbf{14}_1$ to $\mathbf{14}_N$ are fed into the downmixer 16 in the time domain, such as PCM coded, downmixer 16 uses a filter bank, such as a hybrid QMF bank, e.g., a bank of complex exponentially modulated filters with a Nyquist filter extension for the lowest frequency bands to increase the frequency resolution therein, in order to transfer the signals into spectral domain in which the audio signals are represented in several subbands associated with different spectral portions, at a specific filter bank resolution. If the audio signals $\mathbf{14}_1$ to $\mathbf{14}_N$ are already in the representation expected by downmixer 16, same does not have to perform the spectral decomposition.

Figure 2:
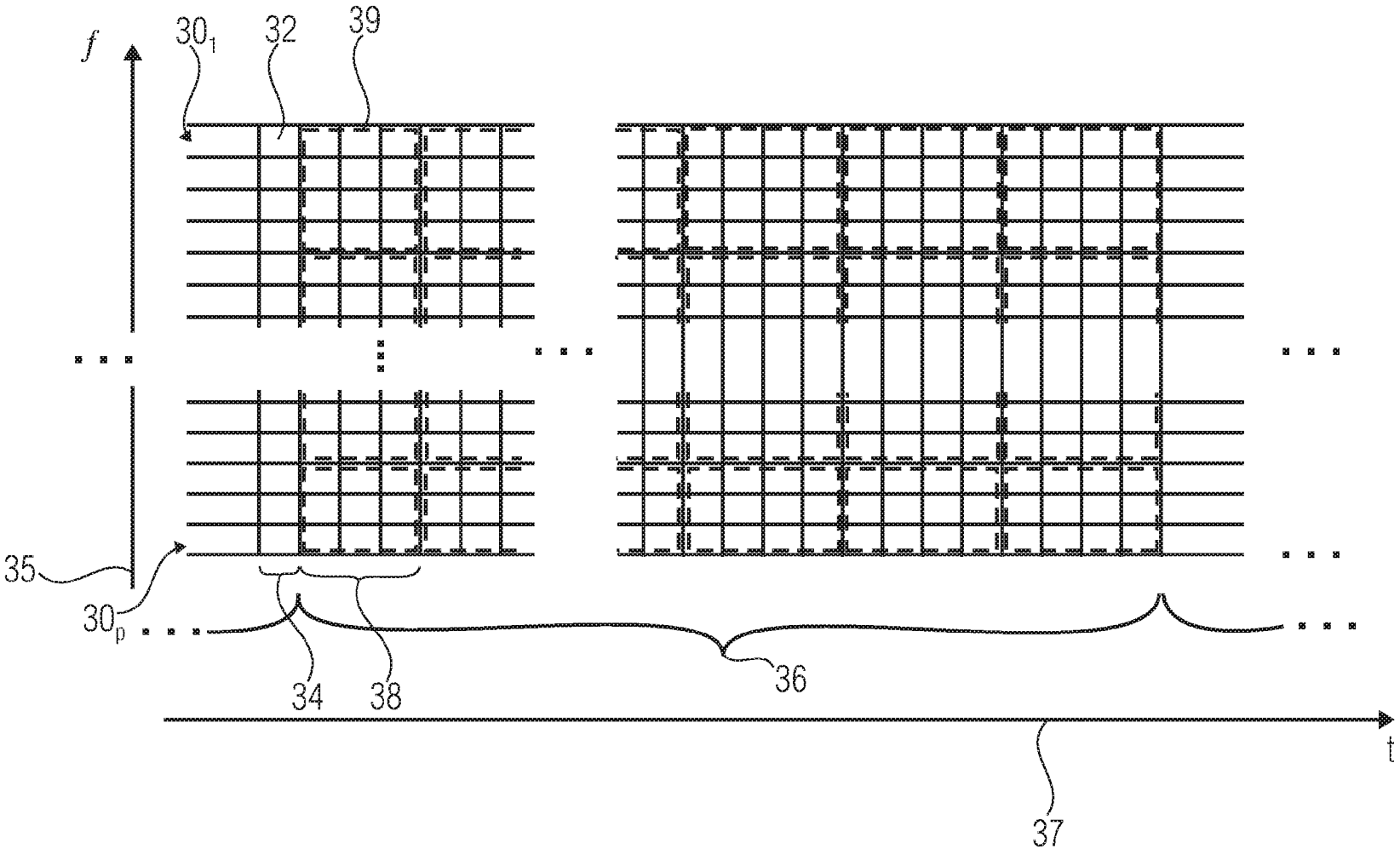
FIG. 2 shows a schematic and illustrative diagram of a spectral representation of a mono audio signal.

FIG. 2 shows an audio signal in the just-mentioned spectral domain. As can be seen, the audio signal is represented as a plurality of subband signals. Each subband signal $\mathbf{30}_1$ to $\mathbf{30}_P$ consists of a sequence of subband values indicated by the small boxes 32. As can be seen, the subband values 32 of the subband signals $\mathbf{30}_1$ to $\mathbf{30}_P$ are synchronized to each other in time so that for each of consecutive filter bank time slots 34, each subband $\mathbf{30}_1$ to $\mathbf{30}_P$ comprises exact one subband value 32. As illustrated by the frequency axis 35, the subband signals $\mathbf{30}_1$ to $\mathbf{30}_P$ are associated with different frequency regions, and as illustrated by the time axis 37, the filter bank time slots 34 are consecutively arranged in time.

As outlined above, downmixer 16 computes SAOC-parameters from the input audio signals $\mathbf{14}_1$ to $\mathbf{14}_N$. Downmixer 16 performs this computation in a time/frequency resolution which may be decreased relative to the original time/frequency resolution as determined by the filter bank time slots 34 and subband decomposition, by a certain amount, wherein this certain amount may be signaled to the decoder side within the side information 20 by respective syntax elements bsFrameLength and bsFregRes. For example, groups of consecutive filter bank time slots 34 may form a frame 36, respectively. In other words, the audio signal may be divided-up into frames overlapping in time or being immediately adjacent in time, for example. In this case, bsFrameLength may define the number of parameter time slots 38 per frame, i.e. the time unit at which the SAOC parameters such as OLD and IOC, are computed in an SAOC frame 36 and bsFregRes may define the number of processing frequency bands for which SAOC parameters are computed, i.e. the number of bands into which the frequency domain is subdivided and for which the SAOC parameters are determined and transmitted. By this measure, each frame is divided-up into time/frequency tiles exemplified in FIG. 2 by dashed lines 39.

The downmixer 16 calculates SAOC parameters according to the following formulas. In particular, downmixer 16 computes object level differences for each object i as $$OLD_i = \frac{\sum_n \sum_{k \in m} x_i^{n,k} x_i^{n,k*}}{\max_j \left( \sum_n \sum_{k \in m} x_j^{n,k} x_j^{n,k*} \right)}$$

wherein the sums and the indices n and k, respectively, go through all filter bank time slots 34, and all filter bank subbands 30 which belong to a certain time/frequency tile 39. Thereby, the energies of all subband values $x_i$ of an audio signal or object i are summed up and normalized to the highest energy value of that tile among all objects or audio signals.

Further the SAOC downmixer 16 is able to compute a similarity measure of the corresponding time/frequency tiles of pairs of different input objects $\mathbf{14}_1$ to $\mathbf{14}_N$. Although the SAOC downmixer 16 may compute the similarity measure between all the pairs of input objects $\mathbf{14}_1$ to $\mathbf{14}_N$, downmixer 16 may also suppress the signaling of the similarity measures or restrict the computation of the similarity measures to audio objects $\mathbf{14}_1$ to $\mathbf{14}_N$ which form left or right channels of a common stereo channel. In any case, the similarity measure is called the inter-object cross correlation parameter $IOC_{i,j}$. The computation is as follows $$IOC_{i,j} = IOC_{j,i} = \mathrm{Re}\left\{ \frac{\sum_n \sum_{k \in m} x_i^{n,k} x_j^{n,k*}}{\sqrt{\sum_n \sum_{k \in m} x_i^{n,k} x_i^{n,k*} \sum_n \sum_{k \in m} x_j^{n,k} x_j^{n,k*}}} \right\}$$

with again indexes n and k going through all subband values belonging to a certain time/frequency tile 39, and i and j denoting a certain pair of audio objects $\mathbf{14}_1$ to $\mathbf{14}_N$.

The downmixer 16 downmixes the objects $\mathbf{14}_1$ to $\mathbf{14}_N$ by use of gain factors applied to each object $\mathbf{14}_1$ to $\mathbf{14}_N$.

In the case of a stereo downmix signal, which case is exemplified in FIG. 1, a gain factor $D_{1,i}$ is applied to object i and then all such gain amplified objects are summed-up in order to obtain the left downmix channel L0, and gain factors $D_{2,i}$ are applied to object i and then the thus gain-amplified objects are summed-up in order to obtain the right downmix channel R0. Thus, factors $D_{1,i}$ and $D_{2,i}$ form a downmix matrix D of size 2×N with $$D = \begin{pmatrix} D_{1,1} & \dots & D_{1,N} \\ D_{2,1} & \dots & D_N \end{pmatrix} \text{ and } \begin{pmatrix} LO \\ RO \end{pmatrix} = D \cdot \begin{pmatrix} Obj_1 \\ \vdots \\ Obj_N \end{pmatrix}.$$

This downmix prescription is signaled to the decoder side by means of down mix gains $DMG_i$ and, in case of a stereo downmix signal, downmix channel level differences $DCLD_i$.

The downmix gains are calculated according to:

$$DMG_i = 10 \log_{10}(D_{1,i}^2 + D_{2,i}^2 + \epsilon),$$

where $\epsilon$ is a small number such as $10^{-9}$ or 96 dB below maximum signal input.

For the $DCLD_s$ the following formula applies:

$$DCLD_1 = 10\log_{10}\left(\frac{D_{1,i}^2}{D_{2,i}^2}\right).$$

The downmixer 16 generates the stereo downmix signal according to:

$$\begin{pmatrix} L0 \\ R0 \end{pmatrix} = \begin{pmatrix} D_1 \\ D_2 \end{pmatrix} \cdot \begin{pmatrix} Obj_1 \\ \vdots \\ Obj_N \end{pmatrix}$$

Thus, in the above-mentioned formulas, parameters OLD and IOC are a function of the audio signals and parameters DMG and DCLD are a function of D. By the way, it is noted that D may be varying in time.

In case of binaural rendering, which mode of operation of the decoder is described here, the output signal naturally comprises two channels, i.e. M'=2. Nevertheless, the aforementioned rendering information 26 indicates as to how the input signals $\mathbf{14}_1$ to $\mathbf{14}_N$ are to be distributed onto virtual speaker positions 1 to M where M might be higher than 2. The rendering information, thus, may comprise a rendering matrix M indicating as to how the input objects $obj_i$ are to be distributed onto the virtual speaker positions j to obtain virtual speaker signals $vs_j$ with j being between 1 and M inclusively and i being between 1 and N inclusively, with $$\begin{pmatrix} vs_1 \\ \vdots \\ vs_M \end{pmatrix} = M \cdot \begin{pmatrix} Obj_1 \\ \vdots \\ Obj_N \end{pmatrix}$$

The rendering information may be provided or input by the user in any way. It may even possible that the rendering information 26 is contained within the side information of the SAOC stream 21 itself. Of course, the rendering information may be allowed to be varied in time. For instance, the time resolution may equal the frame resolution, i.e. M may be defined per frame 36. Even a variance of M by frequency may be possible. For example, M could be defined for each tile 39. Below, for example, $M_{ren}^{l,m}$ will be used for denoting M, with m denoting the frequency band and 1 denoting the parameter time slice 38.

Finally, in the following, the HRTFs 27 will be mentioned. These HRTFs describe how a virtual speaker signal j is to be rendered onto the left and right ear, respectively, so that binaural cues are preserved. In other words, for each virtual speaker position j, two HRTFs exist, namely one for the left ear and the other for the right ear. AS will be described in more detail below, it is possible that the decoder is provided with HRTF parameters 27 which comprise, for each virtual speaker position j, a phase shift offset $\Phi_j$ describing the phase shift offset between the signals received by both ears and stemming from the same source j, and two amplitude magnifications/attenuations $P_{i,R}$ and $P_{i,L}$ for the right and left ear, respectively, describing the attenuations of both signals due to the head of the listener. The HRTF parameter 27 could be constant over time but are defined at some frequency resolution which could be equal to the SAOC parameter resolution, i.e. per frequency band. In the following, the HRTF parameters are given as $\Phi_j^m$, $P_{j,R}^m$ and $P_{j,L}^m$ with m denoting the frequency band.

Figure 3:
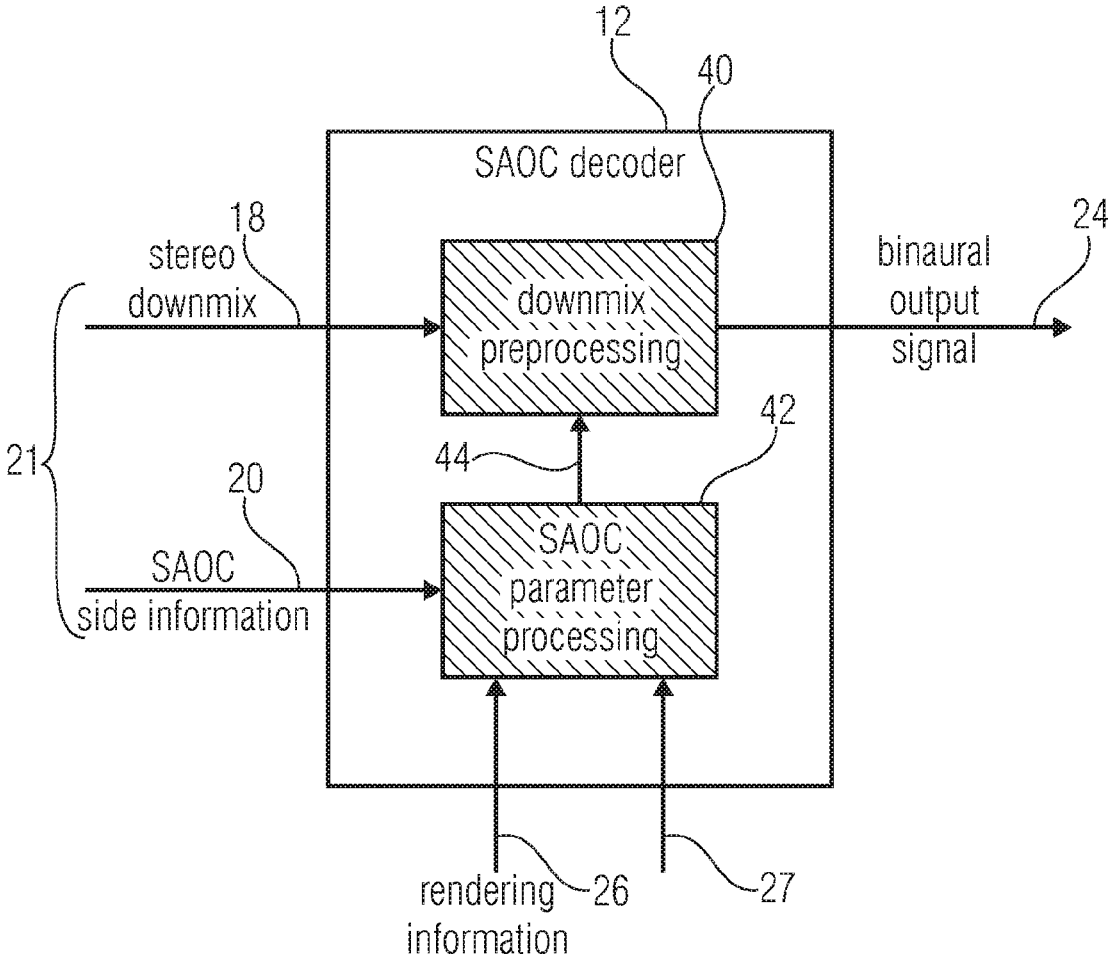
FIG. 3 shows a block diagram of an audio decoder capable of binaural rendering according to an embodiment of the present invention.

FIG. 3 shows the SAOC decoder 12 of FIG. 1 in more detail. As shown therein, the decoder 12 comprises a downmix pre-processing unit 40 and an SAOC parameter processing unit 42. The downmix pre-processing unit 40 is configured to receive the stereo downmix signal 18 and to convert same into the binaural output signal 24. The downmix pre-processing unit 40 performs this conversion in a manner controlled by the SAOC parameter processing unit 42. In particular, the SAOC parameter processing unit 42 provides downmix pre-processing unit 40 with a rendering prescription information 44 which the SAOC parameter processing unit 42 derives from the SAOC side information 20 and rendering information 26.

Figure 4:
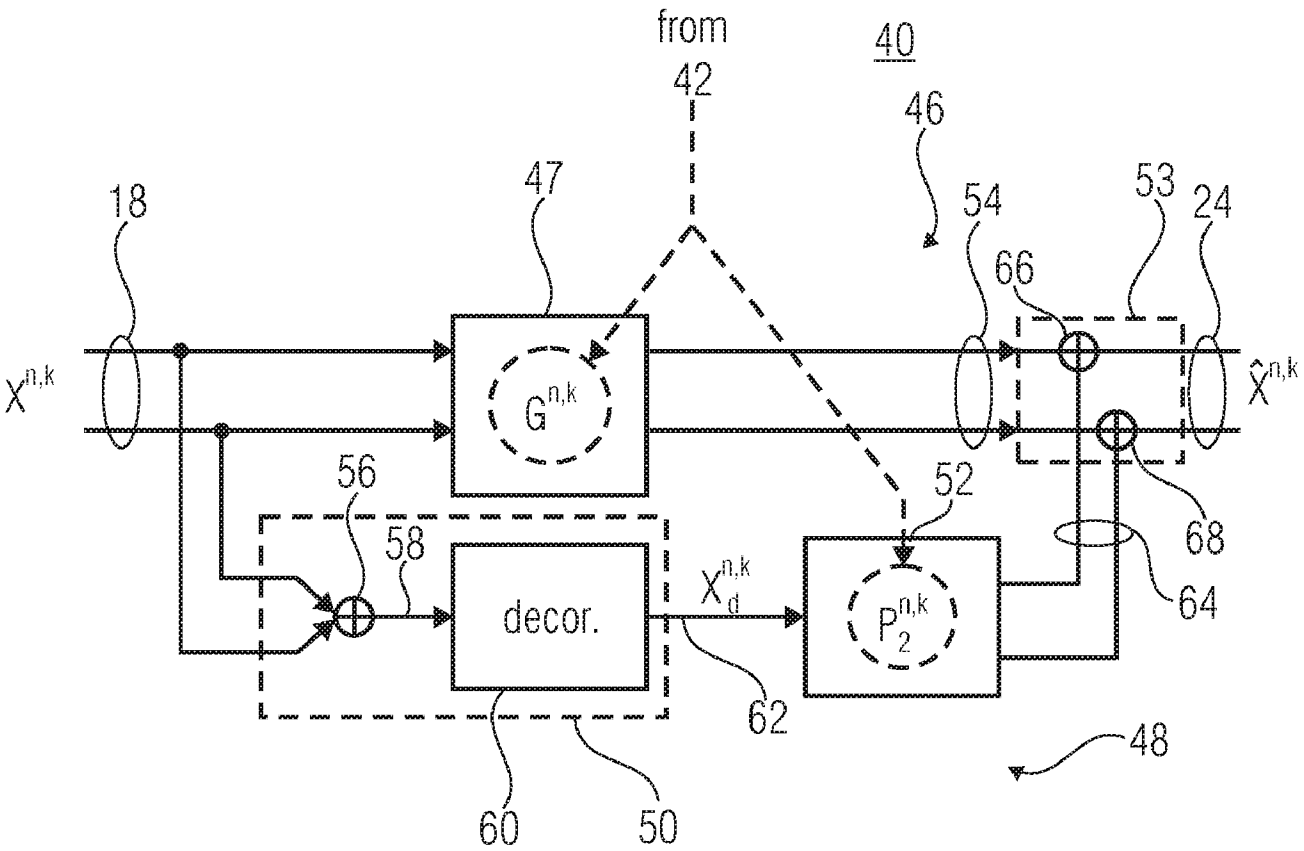
FIG. 4 shows a block diagram of the downmix pre-processing block of FIG. 3 according to an embodiment of the present invention.

FIG. 4 shows the downmix pre-processing unit 40 in accordance with an embodiment of the present invention in more detail. In particular, in accordance with FIG. 4, the downmix pre-processing unit 40 comprises two paths connected in parallel between the input at which the stereo downmix signal 18, i.e. $X^{n,k}$ is received, and an output of unit 40 at which the binaural output signal $\hat{X}^{n,k}$ is output, namely a path called dry path 46 into which a dry rendering unit is serially connected, and a wet path 48 into which a decorrelation signal generator 50 and a wet rendering unit 52 are connected in series, wherein a mixing stage 53 mixes the outputs of both paths 46 and 48 to obtain the final result, namely the binaural output signal 24.

As will be described in more detail below, the dry rendering unit 47 is configured to compute a preliminary binaural output signal 54 from the stereo downmix signal 18 with the preliminary binaural output signal 54 representing the output of the dry rendering path 46. The dry rendering unit 47 performs its computation based on a dry rendering prescription presented by the SAOC parameter processing unit 42. In the specific embodiment described below, the rendering prescription is defined by a dry rendering matrix $G^{n,k}$. The just-mentioned provision is illustrated in FIG. 4 by means of a dashed arrow.

The decorrelated signal generator 50 is configured to generate a decorrelated signal $X_d^{n,k}$ from the stereo downmix signal 18 by downmixing such that same is a perceptual equivalent to a mono downmix of the right and left channel of the stereo downmix signal 18 with, however, being decorrelated to the mono downmix. As shown in FIG. 4, the decorrelated signal generator 50 may comprise an adder 56 for summing the left and right channel of the stereo downmix signal 18 at, for example, a ratio 1:1 or, for example, some other fixed ratio to obtain the respective mono downmix 58, followed by a decorrelator 60 for generating the afore-mentioned decorrelated signal $X_d^{n,k}$. The decorrelator 60 may, for example, comprise one or more delay stages in order to form the decorrelated signal $X_d^{n,k}$ from the delayed version or a weighted sum of the delayed versions of the mono downmix 58 or even a weighted sum over the mono downmix 58 and the delayed version(s) of the mono downmix. Of course, there are many alternatives for the decorrelator 60. In effect, the decorrelation performed by the decorrelator 60 and the decorrelated signal generator 50, respectively, tends to lower the inter-channel coherence between the decorrelated signal 62 and the mono downmix 58 when measured by the above-mentioned formula corresponding to the inter-object cross correlation, with substantially maintaining the object level differences thereof when measured by the above-mentioned formula for object level differences.

The wet rendering unit 52 is configured to compute a corrective binaural output signal 64 from the decorrelated signal 62, the thus obtained corrective binaural output signal 64 representing the output of the wet rendering path 48. The wet rendering unit 52 bases its computation on a wet rendering prescription which, in turn, depends on the dry rendering prescription used by the dry rendering unit 47 as described below. Accordingly, the wet rendering prescription which is indicated as $P_2^{n,k}$ in FIG. 4, is obtained from the SAOC parameter processing unit 42 as indicated by the dashed arrow in FIG. 4.

The mixing stage 53 mixes both binaural output signals 54 and 64 of the dry and wet rendering paths 46 and 48 to obtain the final binaural output signal 24. As shown in FIG. 4, the mixing stage 53 is configured to mix the left and right channels of the binaural output signals 54 and 64 individually and may, accordingly, comprise an adder 66 for summing the left channels thereof and an adder 68 for summing the right channels thereof, respectively.

After having described the structure of the SAOC decoder 12 and the internal structure of the downmix pre-processing unit 40, the functionality thereof is described in the following. In particular, the detailed embodiments described below present different alternatives for the SAOC parameter processing unit 42 to derive the rendering prescription information 44 thereby controlling the inter-channel coherence of the binaural object signal 24. In other words, the SAOC parameter processing unit 42 not only computes the rendering prescription information 44, but concurrently controls the mixing ratio by which the preliminary and corrective binaural signals 55 and 64 are mixed into the final binaural output signal 24.

Figure 5:
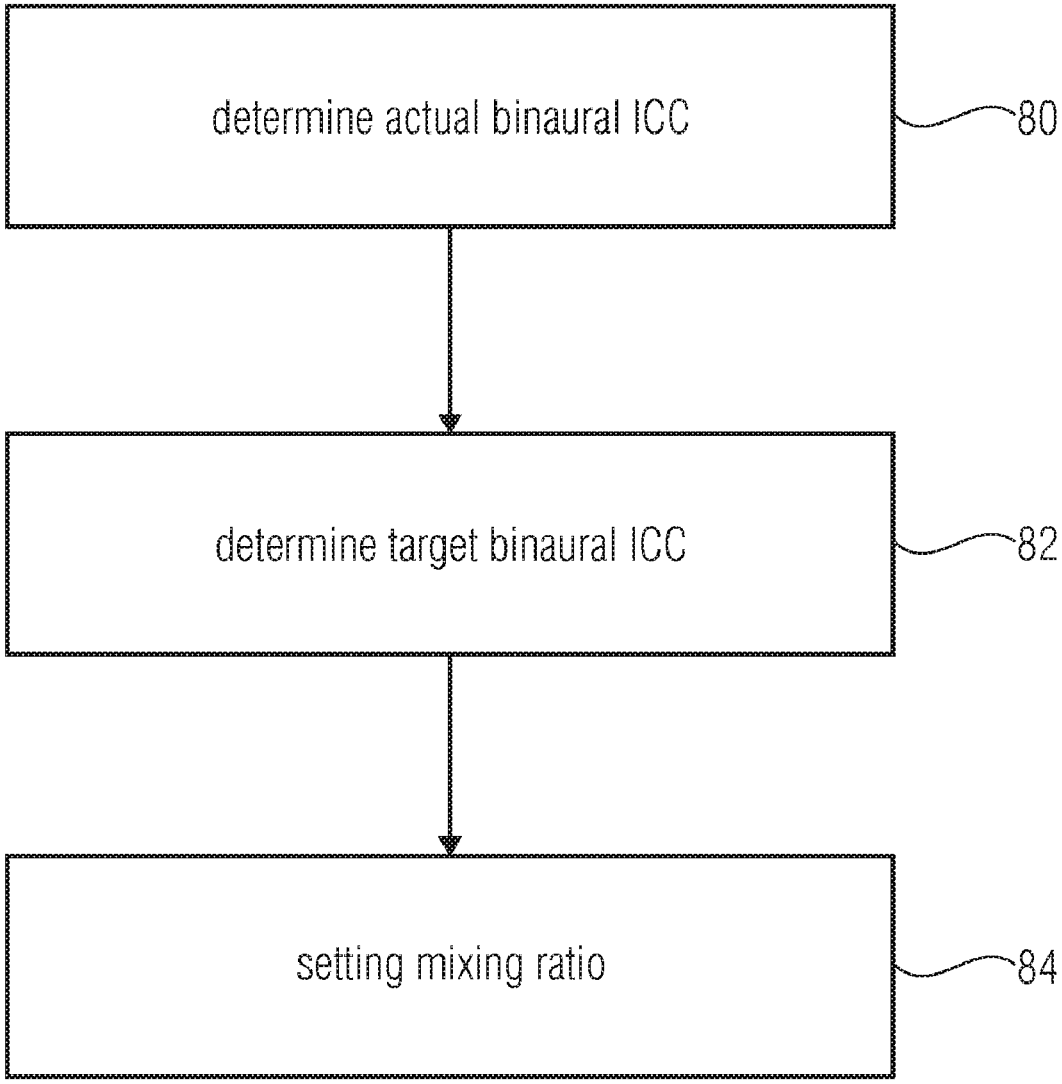
FIG. 5 shows a flow-chart of steps performed by SAOC parameter processing unit 42 of FIG. 3 according to a first alternative.

In accordance with a first alternative, the SAOC parameter processing unit 42 is configured to control the just-mentioned mixing ratio as shown in FIG. 5. In particular, in a step 80, an actual binaural inter-channel coherence value of the preliminary binaural output signal 54 is determined or estimated by unit 42. In a step 82, SAOC parameter processing unit 42 determines a target binaural inter-channel coherence value. Based on these thus determined inter-channel coherence values, the SAOC parameter processing unit 42 sets the afore-mentioned mixing ratio in step 84. In particular, step 84 may comprise the SAOC parameter processing unit 42 appropriately computing the dry rendering prescription used by dry rendering unit 42 and the wet rendering prescription used by wet rendering unit 52, respectively, based on the inter-channel coherence values determined in steps 80 and 82, respectively.

In the following, the afore-mentioned alternatives will be described on a mathematical basis. The alternatives differ from each other in the way the SAOC parameter processing unit 42 determines the rendering prescription information 44, including the dry rendering prescription and the wet rendering prescription with inherently controlling the mixing ratio between dry and wet rendering paths 46 and 48. In accordance with the first alternative depicted in FIG. 5, the SAOC parameter processing unit 42 determines a target binaural inter-channel coherence value. As will be described in more detail below, unit 42 may perform this determination based on components of a target coherence matrix $F=A\cdot E\cdot A^*$, with "*" denoting conjugate transpose, A being a target binaural rendering matrix relating the objects/audio signals 1 . . . N to the right and left channel of the binaural output signal 24 and preliminary binaural output signal 54, respectively, and being derived from the rendering information 26 and HRTF parameters 27, and E being a matrix the coefficients of which are derived from the and object level differences $OLD_i^{l,m}$. The computation may be performed in the spatial/temporal resolution of the SAOC parameters, i.e. for each (l,m). However, it is further possible to perform the computation in a lower resolution with interpolating between the respective results. The latter statement is also true for the subsequent computations set out below.

As the target binaural rendering matrix A relates input objects 1 . . . N to the left and right channels of the binaural output signal 24 and the preliminary binaural output signal 54, respectively, same is of size 2×N, i.e.

$$A = \begin{pmatrix} a_{11} & \dots & a_{1N} \\ a_{21} & \dots & a_{2N} \end{pmatrix}$$

The afore-mentioned matrix E is of size N×N with its coefficients being defined as $$e_{ij}=\sqrt{OLD_i \cdot OLD_j}\cdot \max(IOC_{ij},0)$$

Thus, the matrix E with $$E = \begin{pmatrix} e_{11} & \dots & e_{1N} \\ \vdots & \ddots & \vdots \\ e_{N1} & \dots & e_{NN} \end{pmatrix}$$

has along it diagonal the object level differences, i.e.

$$e_{ii}=OLD_i$$

since $IOC_{ij}=1$ for i=j whereas matrix E has outside its diagonal matrix coefficients representing the geometric mean of the object level differences of objects i and j, respectively, weighted with the inter-object cross correlation measure $IOC_{ij}$ (provided same is greater than 0 with the coefficients being set to 0 otherwise).

Compared thereto, the second and third alternatives described below, seek to obtain the rendering matrixes by finding the best match in the least square sense of the equation which maps the stereo downmix signal 18 onto the preliminary binaural output signal 54 by means of the dry rendering matrix G to the target rendering equation mapping the input objects via matrix A onto the "target" binaural output signal 24 with the second and third alternative differing from each other in the way the best match is formed and the way the wet rendering matrix is chosen.

In order to ease the understanding of the following alternatives, the afore-mentioned description of FIGS. 3 and 4 is mathematically re-described. As described above, the stereo downmix signal 18 $X^{n,k}$ reaches the SAOC decoder 12 along with the SAOC parameters 20 and user defined rendering information 26. Further, SAOC decoder 12 and SAOC parameter processing unit 42, respectively, have access to an HRTF database as indicated by arrow 27. The transmitted SAOC parameters comprise object level differences $OLD_i^{l,m}$, inter-object cross correlation values $IOC_{ij}^{l,m}$, downmix gains $DMG_i^{l,m}$ and downmix channel level differences $DCLD_i^{l,m}$ for all N objects i, j with "l,m" denoting the respective time/ spectral tile 39 with l specifying time and m specifying frequency. The HRTF parameters 27 are, exemplarily, assumed to be given as $P_{q,L}^{m}$, $P_{q,R}^{m}$ and $\Phi_q^{m}$ for all virtual speaker positions or virtual spatial sound source position q, for left (L) and right (R) binaural channel and for all frequency bands m.

The downmix pre-processing unit 40 is configured to compute the binaural output $\hat{X}^{n,k}$, as computed from the stereo downmix $X^{n,k}$ and decorrelated mono downmix signal $X_d^{n,k}$ as $$\hat{X}^{n,k}=G^{n,k}X^{n,k}+P_2^{n,k}X_d^{n,k}$$

The decorrelated signal $X_d^{n,k}$ is perceptually equivalent to the sum 58 of the left and right downmix channels of the stereo downmix signal 18 but maximally decorrelated to it according to $$X_d^{n,k}=\text{decorrFunction}((1\ 1)X^{n,k})$$

Referring to FIG. 4, the decorrelated signal generator 50 performs the function decorrFunction of the above-mentioned formula.

Further, as also described above, the downmix pre-processing unit 40 comprises two parallel paths 46 and 48. Accordingly, the above-mentioned equation is based on two time/frequency dependent matrices, namely, $G^{l,m}$ for the dry and $P_2^{l,m}$ for the wet path.

As shown in FIG. 4, the decorrelation on the wet path may be implemented by the sum of the left and right downmix channel being fed into a decorrelator 60 that generates a signal 62, which is perceptually equivalent, but maximally decorrelated to its input 58.

The elements of the just-mentioned matrices are computed by the SAOC pre-processing unit 42. As also denoted above, the elements of the just-mentioned matrices may be computed at the time/frequency resolution of the SAOC parameters, i.e. for each time slot l and each processing band m. The matrix elements thus obtained may be spread over frequency and interpolated in time resulting in matrices $E^{n,k}$ and $P_2^{l,m}$ defined for all filter bank time slots n and frequency subbands k. However, as already above, there are also alternatives. For example, the interpolation could be left away, so that in the above equation the indices n,k could effectively be replaced by "l,m". Moreover, the computation of the elements of the just-mentioned matrices could even be performed at a reduced time/frequency resolution with interpolating onto resolution l,m or n,k. Thus, again, although in the following the indices l,m indicate that the matrix calculations are performed for each tile 39, the calculation may be performed at some lower resolution wherein, when applying the respective matrices by the downmix pre-processing unit 40, the rendering matrices may be interpolated until a final resolution such as down to the QMF time/frequency resolution of the individual subband values 32.

According to the above-mentioned first alternative, the dry rendering matrix $G^{l,m}$ is computed for the left and the right downmix channel separately such that $$G^{l,m}=\begin{pmatrix} P_L^{l,m,1}\cos(\beta^{l,m}+\alpha^{l,m})\exp\left(j\frac{\phi^{l,m,1}}{2}\right) & P_L^{l,m,2}\cos(\beta^{l,m}+\alpha^{l,m})\exp\left(j\frac{\phi^{l,m,2}}{2}\right) \\ P_R^{l,m,1}\cos(\beta^{l,m}-\alpha^{l,m})\exp\left(-j\frac{\phi^{l,m,1}}{2}\right) & P_R^{l,m,2}\cos(\beta^{l,m}-\alpha^{l,m})\exp\left(-j\frac{\phi^{l,m,2}}{2}\right) \end{pmatrix}$$

The corresponding gains $P_L^{l,m,x}$, $P_R^{l,m,x}$ and phase differences $\phi^{l,m,x}$ are defined as $$P_L^{l,m,x}=\sqrt{\frac{f_{11}^{l,m,x}}{V^{l,m,x}}},\ P_R^{l,m,x}=\sqrt{\frac{f_{22}^{l,m,x}}{V^{l,m,x}}},$$

$$\phi^{l,m,x}=\begin{cases}\arg\left(f_{12}^{l,m,x}\right) & \text{if } 0\le m\le const_1 \wedge \dfrac{|f_{12}^{l,m,x}|}{\sqrt{f_{11}^{l,m,x}f_{22}^{l,m,x}}}\ge const_2 \\ 0 & \text{else}\end{cases}$$

wherein $const_1$ may be, for example, 11 and $const_2$ may be 0.6. The index x denotes the left or right downmix channel and accordingly assumes either 1 or 2.

Generally speaking, the above condition distinguishes between a higher spectral range and a lower spectral range and, especially, is (potentially) fulfilled only for the lower spectral range. Additionally or alternatively, the condition is dependent on as to whether one of the actual binaural inter-channel coherence value and the target binaural inter-channel coherence value has a predetermined relationship to a coherence threshold value or not, with the condition being (potentially) fulfilled only if the coherence exceeds the threshold value. The just mentioned individual sub-conditions may, as indicated above, be combined by means of an and operation.

The scalar $V^{l,m,x}$ is computed as $$V^{l,m,x}=D^{l,m,x}E^{l,m}(D^{l,m,x})+\epsilon.$$

It is noted that $\epsilon$ may be the same as or different to the $\epsilon$ mentioned above with respect to the definition of the downmix gains. The matrix E has already been introduced above. The index (l,m) merely denotes the time/frequency dependence of the matrix computation as already mentioned above. Further, the matrices $D^{l,m,x}$ had also been mentioned above, with respect to the definition of the downmix gains and the downmix channel level differences, so that $D^{l,m,1}$ corresponds to the afore-mentioned $D_1$ and $D^{l,m,2}$ corresponds to the afore-mentioned $D_2$.

However, in order to ease the understanding how the SAOC parameter processing unit 42 derives the dry generating matrix $G^{l,m}$ from the received SAOC parameters, the correspondence between channel downmix matrix $D^{l,m,x}$ and the downmix prescription comprising the downmix gains $DMG_i^{l,m}$ and $DCLD_i^{l,m}$ is presented again, in the inverse direction. In particular, the elements $d_i^{l,m,x}$ of the channel downmix matrix $D^{l,m,x}$ of size 1×N, i.e. $D^{l,m,x}=(d_1^{l,m,x}, \ldots d_N^{l,m,x})$ are given as $$d_i^{l,m,1}=10\frac{DMG_i^{l,m}}{20}\sqrt{\frac{\tilde{d}_i^{l,m}}{1+\tilde{d}_i^{l,m}}},\ d_i^{l,m,2}=10\frac{DMG_i^{l,m}}{20}\sqrt{\frac{1}{1+\tilde{d}_i^{l,m}}}$$

with the element $\tilde{d}_i^{l,m}$ being defined as $$\tilde{d}_i^{l,m}=10^{\frac{DCLD_i^{l,m}}{10}}.$$

In the above equation of $G^{l,m}$, the gains and $P_L^{l,m,x}$ and $P_R^{l,m,x}$ and the phase differences $\phi^{l,m,x}$ depend on coefficients $f_{\mu\nu}$ of a channel-x individual target covariance matrix $F^{l,m,x}$, which, in turn, as will be set out in more detail below, depends on a matrix $E^{l,m,x}$ of size N×N the elements $e_{ij}^{l,m,x}$ of which are computed as $$e_{ij}^{l,m,x} = e_{ij}^{l,m}\left(\frac{d_i^{l,m,x}}{d_i^{l,m,1} + d_i^{l,m,2}}\right)\left(\frac{d_j^{l,m,x}}{d_j^{l,m,1} + d_j^{l,m,2}}\right).$$

The elements $e_{ij}^{l,m,x}$ of the matrix $E^{l,m}$ of size N×N are, as stated above, given as $e_{ij}^{l,m,x} = \sqrt{OLD_i^{l,m} \cdot OLD_j^{l,m}} \cdot \max(IOC_{ij}^{l,m}, 0)$.

The just-mentioned target covariance matrix $F^{l,m,x}$ of size 2×2 with elements $f_{uv}^{l,m,x}$ is, similarly to the covariance matrix F indicated above, given as $$F^{l,m,x} = A^{l,m} E^{l,m,x} (A^{l,m})^*,$$

where "*" corresponds to conjugate transpose.

The target binaural rendering matrix $A^{l,m}$ is derived from the HRTF parameters $\Phi_q^m$, $P_{q,R}^m$ and $P_{q,L}^m$ for all $N_{HRTF}$ virtual speaker positions q and the rendering matrix $M_{ren}^{l,m}$ and is of size 2×N. Its elements $a_{ui}^{l,m,x}$ define the desired relation between all objects i and the binaural output signal as $$a_{1,i}^{l,m} = \sum_{q=0}^{N_{HRTF}-1} m_{q,i}^{l,m} P_{q,L}^m \exp\left(j\frac{\phi_q^m}{2}\right),$$

$$a_{2,i}^{l,m} = \sum_{q=0}^{N_{HRTF}-1} m_{q,i}^{l,m} P_{q,R}^m \exp\left(-j\frac{\phi_q^m}{2}\right).$$

The rendering matrix $M_{ren}^{l,m}$ with elements $m_{qi}^{l,m}$ relates every audio object i to a virtual speaker q represented by the HRTF.

The wet upmix matrix $P_2^{l,m}$ is calculated based on matrix $G^{l,m}$ as $$P_2^{l,m} = \begin{pmatrix} P_L^{l,m}\sin(\beta^{l,m} + \alpha^{l,m})\exp\left(j\frac{\arg(c_{12}^{l,m})}{2}\right) \\ P_R^{l,m}\sin(\beta^{l,m} - \alpha^{l,m})\exp\left(-j\frac{\arg(c_{12}^{l,m})}{2}\right) \end{pmatrix}$$

The gains $P_L^{l,m}$ and $P_R^{l,m}$ are defined as $$P_L^{l,m} = \sqrt{\frac{c_{11}^{l,n}}{V^{l,m}}},\ P_R^{l,m} = \sqrt{\frac{c_{22}^{l,m}}{V^{l,m}}}.$$

The 2×2 covariance matrix $C^{l,m}$ with elements $c_{u,v}^{l,m,x}$ of the dry binaural signal 54 is estimated as $$C^{l,m} = \tilde{G}^{l,m} D^{l,m} E^{l,m} (D^{l,m})^* (\tilde{G}^{l,m})^*$$

where $$\tilde{G}^{l,m} = \begin{pmatrix} P_L^{l,m,1}\exp\left(j\frac{\phi^{l,m,1}}{2}\right) & P_L^{l,m,2}\exp\left(j\frac{\phi^{l,m,2}}{2}\right) \\ P_R^{l,m,1}\exp\left(-j\frac{\phi^{l,m,1}}{2}\right) & P_R^{l,m,2}\exp\left(-j\frac{\phi^{l,m,2}}{2}\right) \end{pmatrix}$$

The scalar $V^{l,m}$ is computed as $$V^{l,m} = W^{l,m} E^{l,m} (W^{l,m})^* + \epsilon.$$

The elements $w_i^{l,m}$ of the wet mono downmix matrix $W^{l,m}$ of size 1×N are given as $$w_i^{l,m} = d_i^{l,m,1} + d_i^{l,m,2}.$$

The elements $d_{x,i}^{l,m}$ of the stereo downmix matrix $D^{l,m}$ of size 2×N are given as $$d_{x,i}^{l,m} = d_i^{l,m,x}.$$

In the above-mentioned equation of $G^{l,m}$, $\alpha^{l,m}$ and $\beta^{l,m}$ represent rotator angles dedicated for ICC control. In particular, the rotator angle $\alpha^{l,m}$ controls the mixing of the dry and the wet binaural signal in order to adjust the ICC of the binaural output 24 to that of the binaural target. When setting the rotator angels, the ICC of the dry binaural signal 54 should be taken into account which is, depending on the audio content and the stereo downmix matrix D, typically smaller than 1.0 and greater than the target ICC. This is in contrast to a mono downmix based binaural rendering where the ICC of the dry binaural signal would be equal to 1.0.

The rotator angles $\alpha^{l,m,}$ and $\beta^{l,m}$ control the mixing of the dry and the wet binaural signal. The ICC $\rho_C^{l,m}$ of the dry binaural rendered stereo downmix 54 is, in step 80, estimated as $$\rho_C^{l,m} = \min\left(\frac{|c_{12}^{l,m}|}{\sqrt{c_{11}^{l,m} c_{22}^{l,m}}}, 1\right).$$

The overall binaural target ICC $\rho_C^{l,m}$ is, in step 82, estimated as, or determined to be, $$\rho_T^{l,m} = \min\left(\frac{|f_{12}^{l,m}|}{\sqrt{f_{11}^{l,m} f_{22}^{l,m}}}, 1\right)$$

The rotator angles $\alpha^{l,m}$ and $\beta_{l,m}$ for minimizing the energy of the wet signal are then, in step 84, set to be $$\alpha^{l,m} = \frac{1}{2}\left(\arccos(\rho_T^{l,m}) - \arccos(\rho_C^{l,m})\right),$$

$$\beta^{l,m} = \arctan\left(\tan(\alpha^{l,m})\frac{P_R^{l,m} - P_L^{l,m}}{P_L^{l,m} + P_R^{l,m}}\right).$$

Thus, according to the just-described mathematical description of the functionality of the SAOC decoder 12 for generating the binaural output signal 24, the SAOC parameter processing unit 42 computes, in determining the actual binaural ICC, $\rho_C^{l,m}$ by use of the above-presented equations for $\rho_C^{l,m}$ and the subsidiary equations also presented above. Similarly, SAOC parameter processing unit 42 computes, in determining the target binaural ICC in step 82, the parameter $\rho_C^{l,m}$ by the above-indicated equation and the subsidiary equations. On the basis thereof, the SAOC parameter processing unit 42 determines in step 84 the rotator angles thereby setting the mixing ratio between dry and wet rendering path. With these rotator angles, SAOC parameter processing unit 42 builds the dry and wet rendering matrices or upmix parameters $G^{l,m}$ and $P_2^{l,m}$ which, in turn, are used by downmix pre-processing unit 40—at resolution n,k—in order to derive the binaural output signal 24 from the stereo downmix 18.

It should be noted that the afore-mentioned first alternative may be varied in some way. For example, the above-presented equation for the interchannel phase difference $\Phi_C^{l,m}$ could be changed to the extent that the second sub-condition could compare the actual ICC of the dry binaural rendered stereo downmix to $const_2$ rather than the ICC determined from the channel individual covariance matrix $F^{l,m,x}$ so that in that equation the portion $$\frac{|f_{12}^{l,m,x}|}{\sqrt{f_{11}^{l,m,x} f_{22}^{l,m,x}}}$$

would be replaced by the term $$\frac{|c_{12}^{l,m}|}{\sqrt{c_{11}^{l,m} c_{22}^{l,m}}}.$$

Further, it should be noted that, in accordance with the notation chosen, in some of the above equations, a matrix of all ones has been left away when a scalar constant such as $\epsilon$ was added to a matrix so that this constant is added to each coefficient of the respective matrix.

An alternative generation of the dry rendering matrix with higher potential of object extraction is based on a joint treatment of the left and right downmix channels. Omitting the subband index pair for clarity, the principle is to aim at the best match in the least squares sense of $$\hat{X}=GX$$

to the target rendering $$Y=AS.$$

This yields the target covariance matrix:

$$YY^*=ASS^*A^*$$

where the complex valued target binaural rendering matrix A is given in a previous formula and the matrix S contains the original objects subband signals as rows.

The least squares match is computed from second order information derived from the conveyed object and downmix data. That is, the following substitutions are performed $$XX^* \leftrightarrow DED^*,$$

$$YX^* \leftrightarrow AED^*,$$

$$YY^* \leftrightarrow AEA^*.$$

To motivate the substitutions, recall that SAOC object parameters typically carry information on the object powers (OLD) and (selected) inter-object cross correlations (IOC). From these parameters, the N×N object covariance matrix E is derived, which represents an approximation to SS*, i.e. E≈SS*, yielding YY*=AEA*.

Further, X=DS and the downmix covariance matrix becomes:

$$XX^*=DSS^*D^*,$$

which again can be derived from E by XX*=DED*.

The dry rendering matrix G is obtained by solving the least squares problem $$\min\{\mathrm{norm}\{Y-X\}\}.$$

$$G=G_0=YX^*(XX^*)^{-1}$$

where YX* is computed as YX*=AED*.

Thus, dry rendering unit 42 determines the binaural output signal $\hat{X}$ form the downmix signal X by use of the 2×2 upmix matrix G, by $\hat{X}$=GX, and the SAOC parameter processing unit determines G by use of the above formulae to be $$G=AED^*(DED^*)^{-1},$$

Given this complex valued dry rendering matrix, the complex valued wet rendering matrix P—formerly denoted $P_2$—is computed in the SAOC parameter processing unit 42 by considering the missing covariance error matrix $$\Delta R=YY^*=G_0XX^*G_0^*.$$

It can be shown that this matrix is positive and an advantageous choice of P is given by choosing a unit norm eigenvector u corresponding to the largest eigenvalue λ of ΔR and scaling it according to $$P=\sqrt{\frac{\lambda}{V}}\,u,$$

where the scalar V is computed as noted above, i.e. V=WE(W)+ϵ.

In other words, since the wet path is installed to correct the correlation of the obtained dry solution, ΔR=AEA*−$G_0$DED*$G_0$*. represents the missing covariance error matrix, i.e. YY*=$\hat{X}$ $\hat{X}$*+ΔR or, respectively, ΔR=YY*=$\hat{X}$ $\hat{X}$*, and, therefore, the SAOC parameter processing unit 42 stets P such that PP*=ΔR, one solution for which is given by choosing the above-mentioned unit norm eigenvector u.

A third method for generating dry and wet rendering matrices represents an estimation of the rendering parameters based on cue constrained complex prediction and combines the advantage of reinstating the correct complex covariance structure with the benefits of the joint treatment of downmix channels for improved object extraction. An additional opportunity offered by this method is to be able to omit the wet upmix altogether in many cases, thus paving the way for a version of binaural rendering with lower computational complexity. As with the second alternative, the third alternative presented below is based on a joint treatment of the left and right downmix channels.

The principle is to aim at the best match in the least squares sense of $$\hat{X}=GX$$

to the target rendering Y=AS under the constraint of correct complex covariance $$GXX^*G^*+VPP^*=\hat{Y}\hat{Y}^*.$$

Thus, it is the aim to find a solution for G and P, such that

1) $\hat{Y}\hat{Y}$=YY* (being the constraint to the formulation in 2); and
2) min{norm{Y−$\hat{Y}$}}, as it was requested within the second alternative.

From the theory of Lagrange multipliers, it follows that there exists a self adjoint matrix M=M*, such that $$MP=0, \text{ and}$$

$$MGXX^*=YX^*$$

In the generic case where both YX* and XX* are non-singular it follows from the second equation that M is non-singular, and therefore P=0 is the only solution to the first equation. This is a solution without wet rendering. Setting $K=M^{-1}$ it can be seen that the corresponding dry upmix is given by $$G=KG_0$$

where $G_0$ is the predictive solution derived above with respect to the second alternative, and the self adjoint matrix K solves $$KG_0XX^*G_0^*K^*=YY^*.$$

If the unique positive and hence selfadjoint matrix square root of the matrix $G_0XX^{**}G_0^*$ is denoted by Q, then the solution can be written as $$K=Q^{-1}(QYY^*Q)^{1/2}Q^{-1}.$$

Thus, the SAOC parameter processing unit 42 determines G to be $KG_0=Q^{-1}(QYY^*Q)^{1/2}Q^{-1}$ $G_0=(G_0DED^*G_0^*)^{-1}(G_0DED^*G_0^*\ AEA^*\ G_0\ DED^*G_0^*)^{1/2}(G_0\ DED^*G_0^*)^{-1}G_0$ with $G_0=AED^*(DED^*)^{-1}$.

For the inner square root there will in general be four self-adjoint solutions, and the solution leading to the best match of $\hat{X}$ to Y is chosen.

In practice, one has to limit the dry rendering matrix $G=KG_0$ to a maximum size, for instance by limiting condition on the sum of absolute values squares of all dry rendering matrix coefficients, which can be expressed as $$\mathrm{trace}(GG^*)\leqq g_{max}.$$

If the solution violates this limiting condition, a solution that lies on the boundary is found instead. This is achieved by adding constraint $$\mathrm{trace}(GG^*)=g_{max}$$

to the previous constraints and re-deriving the Lagrange equations. It turns out that the previous equation $$MGXX^*=YX^*$$

has to be replaced by $$MGXX^*+\mu I=YX^*$$

where μ is an additional intermediate complex parameter and I is the 2×2 identity matrix. A solution with nonzero wet rendering P will result. In particular, a solution for the wet upmix matrix can be found by $PP^*=(YY^*-GXX^*G^*)/V=(AEA^*-GDED^*G^*)/V$, wherein the choice of P is of advantage based on the eigenvalue consideration already stated above with respect to the second alternative, and V is $WEW^*+\epsilon$. The latter determination of P is also done by the SAOC parameter processing unit 42.

The thus determined matrices G and P are then used by the wet and dry rendering units as described earlier.

If a low complexity version is needed, the next step is to replace even this solution with a solution without wet rendering. A method to achieve this is to reduce the requirements on the complex covariance to only match on the diagonal, such that the correct signal powers are still achieved in the right and left channels, but the cross covariance is left open.

Regarding the first alternative, subjective listening tests were conducted in an acoustically isolated listening room that is designed to permit high-quality listening. The result is outlined below.

The playback was done using headphones (STAX SR Lambda Pro with Lake-People D/A Converter and STAX SRM-Monitor). The test method followed the standard procedures used in the spatial audio verification tests, based on the "Multiple Stimulus with Hidden Reference and Anchors" (MUSHRA) method for the subjective assessment of intermediate quality audio.

A total of 5 listeners participated in each of the performed tests. All subjects can be considered as experienced listeners. In accordance with the MUSHRA methodology, the listeners were instructed to compare all test conditions against the reference. The test conditions were randomized automatically for each test item and for each listener. The subjective responses were recorded by a computer-based MUSHRA program on a scale ranging from 0 to 100. An instantaneous switching between the items under test was allowed. The MUSHRA tests have been conducted to assess the perceptual performance of the described stereo-to-binaural processing of the MPEG SAOC system.

In order to assess a perceptual quality gain of the described system compared to the mono-to-binaural performance, items processed by the mono-to-binaural system were also included in the test. The corresponding mono and stereo downmix signals were AAC-coded at 80 kbits per second and per channel.

As HRTF database "KEMAR_MIT_COMPACT" was used. The reference condition has been generated by binaural filtering of objects with the appropriately weighted HRTF impulse responses taking into account the desired rendering. The anchor condition is the low pass filtered reference condition (at 3.5 kHz).

Table 1 contains the list of the tested audio items.

TABLE 1

Audio items of the listening tests

| Listening items | Nr. mono/ stereo objects | object angles<br>object gains (dB) |
|---|---|---|
| disco1 | 10/0 | [−30, 0, −20, 40, 5, −5, 120, 0, −20, −40] |
| disco2 | | [−3, −3, −3, −3, −3, −3, −3, −3, −3, −3] |
| | | [−30, 0, −20, 40, 5, −5, 120, 0, −20, −40] |
| | | [−12, −12, 3, 3, −12, −12, 3, −12, 3, −12] |
| coffee1 | 6/0 | [10, −20, 25, −35, 0, 120 |
| coffee2 | | [0, −3, 0, 0, 0, 0] |
| | | [10, −20, 25, −35, 0, 120] |
| | | [3, −20, −15, −15, 3, 3] |
| pop2 | 1/5 | [0, 30, −30, −90, 90, 0, 0, −120, 120, −45, 45] |
| | | [4, −6, −6, 4, 4, −6, −6, −6, −6, −16, −16] |

Five different scenes have been tested, which are the result of rendering (mono or stereo) objects from 3 different object source pools. Three different downmix matrices have been applied in the SAOC encoder, see Table. 2.

TABLE 2

Downmix types

| Downmix type | Mono | Stereo | Dual mono |
|---|---|---|---|
| Matlab notation | dmx1 = ones (1, N); | dmx2 = zeros (2, N) ;<br>dmx2 (1, 1:2:N) = 1;<br>smx2 (2, 2:2:N) = 1; | dmx3 = ones (2, N): |

The upmix presentation quality evaluation tests have been defined as listed in Table 3.

TABLE 3

Listening test conditions

| Text condition | Downmix type | Core-coder |
|---|---|---|
| x-1-b | Mono | AAC@80 kbps |
| x-2-b | Stereo | AAC@160 kbps |

TABLE 3-continued

| Listening test conditions | | |
|---|---|---|
| Text condition | Downmix type | Core-coder |
| x-2-b_Dual/Mono | Dual Mono | AAC@160 kbps |
| 5222 | Stereo | AAC@160 kbps |
| 5222_DualMono | Dual Mono | AAC@160 kbps |

The "5222" system uses the stereo downmix pre-processor as described in ISO/IEC JTC 1/SC 29/WG 11 (MPEG), Document N10045, "ISO/IEC CD 23003-2:200x Spatial Audio Object Coding (SAOC)", 85$^{th}$ MPEG Meeting, July 2008, Hannover, Germany, with the complex valued binaural target rendering matrix $A^{l,m}$ as an input. That is, no ICC control is performed. Informal listening test have shown that by taking the magnitude of $A^{l,m}$ for upper bands instead of leaving it complex valued for all bands improves the performance. The improved "5222" system has been used in the test.

Figure 6:
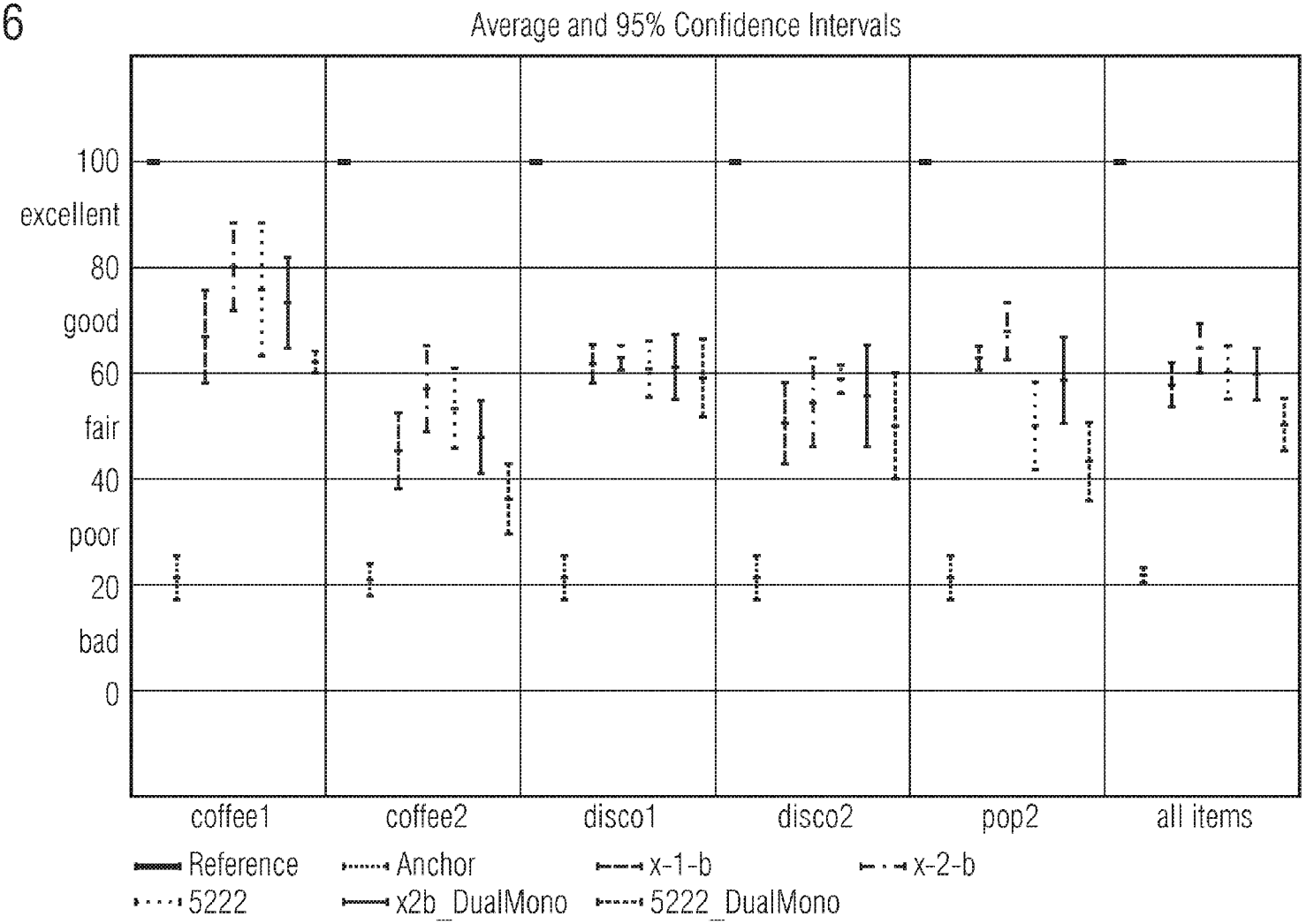
FIG. 6 shows a graph illustrating the listening test results.

A short overview in terms of the diagrams demonstrating the obtained listening test results can be found in FIG. 6. These plots show the average MUSHRA grading per item over all listeners and the statistical mean value over all evaluated items together with the associated 95% confidence intervals. One should note that the data for the hidden reference is omitted in the MUSHRA plots because all subjects have identified it correctly.

The following observations can be made based upon the results of the listening tests:

"x-2-b_DualMono" performs comparable to "5222".

"x-2-b_DualMono" performs clearly better than "5222_DualMono".

"x-2-b_DualMono" performs comparable to "x-1-b"

"x-2-b" implemented according to the above first alternative, performs slightly better than all other conditions.

item "disco1" does not show much variation in the results and may not be suitable.

Thus, a concept for binaural rendering of stereo downmix signals in SAOC has been described above, that fulfils the requirements for different downmix matrices. In particular the quality for dual mono like downmixes is the same as for true mono downmixes which has been verified in a listening test. The quality improvement that can be gained from stereo downmixes compared to mono downmixes can also be seen from the listening test. The basic processing blocks of the above embodiments were the dry binaural rendering of the stereo downmix and the mixing with a decorrelated wet binaural signal with a proper combination of both blocks.

In particular, the wet binaural signal was computed using one decorrelator with mono downmix input so that the left and right powers and the IPD are the same as in the dry binaural signal.

The mixing of the wet and dry binaural signals was controlled by the target ICC and the ICC of the dry binaural signal so that typically less decorrelation is needed than for mono downmix based binaural rendering resulting in higher overall sound quality.

Further, the above embodiments, may be easily modified for any combination of mono/stereo downmix input and mono/stereo/binaural output in a stable manner.

In other words, embodiments providing a signal processing structure and method for decoding and binaural rendering of stereo downmix based SAOC bitstreams with inter-channel coherence control were described above. All combinations of mono or stereo downmix input and mono, stereo or binaural output can be handled as special cases of the described stereo downmix based concept. The quality of the stereo downmix based concept turned out to be typically better than the mono Downmix based concept which was verified in the above described MUSHRA listening test.

In Spatial Audio Object Coding (SAOC) ISO/IEC JTC 1/SC 29/WG 11 (MPEG), Document N10045, "ISO/IEC CD 23003-2:200x Spatial Audio Object Coding (SAOC)", 85$^{th}$ MPEG Meeting, July 2008, Hannover, Germany, multiple audio objects are downmixed to a mono or stereo signal. This signal is coded and transmitted together with side information (SAOC parameters) to the SAOC decoder. The above embodiments enable the inter-channel coherence (ICC) of the binaural output signal being an important measure for the perception of virtual sound source width, and being, due to the encoder downmix, degraded or even destroyed, (almost) completely to be corrected.

The inputs to the system are the stereo downmix, SAOC parameters, spatial rendering information and an HRTF database. The output is the binaural signal. Both input and output are given in the decoder transform domain typically by means of an oversampled complex modulated analysis filter bank such as the MPEG Surround hybrid QMF filter bank, ISO/IEC 23003-1:2007, Information technology—MPEG audio technologies—Part 1: MPEG Surround with sufficiently low inband aliasing. The binaural output signal is converted back to PCM time domain by means of the synthesis filter bank. The system is thus, in other words, an extension of a potential mono downmix based binaural rendering towards stereo Downmix signals. For dual mono Downmix signals the output of the system is the same as for such mono Downmix based system. Therefore the system can handle any combination of mono/stereo Downmix input and mono/stereo/binaural output by setting the rendering parameters appropriately in a stable manner.

In even other words, the above embodiments perform binaural rendering and decoding of stereo downmix based SAOC bit streams with ICC control. Compared to a mono downmix based binaural rendering, the embodiments can take advantage of the stereo downmix in two ways:

Correlation properties between objects in different downmix channels are partly preserved Object extraction is improved since few objects are present in one downmix channel Thus, a concept for binaural rendering of stereo downmix signals in SAOC has been described above that fulfils the requirements for different downmix matrices. In particular, the quality for dual mono like downmixes is the same as for true mono downmixes which has been verified in a listening test. The quality improvement that can be gained from stereo downmixes compared to mono downmixes can also be seen from the listening test. The basic processing blocks of the above embodiments were the dry binaural rendering of the stereo downmix and the mixing with a decorrelated wet binaural signal with a proper combination of both blocks. In particular, the wet binaural signal was computed using one decorrelator with mono downmix input so that the left and right powers and the IPD are the same as in the dry binaural signal. The mixing of the wet and dry binaural signals was controlled by the target ICC and the mono downmix based binaural rendering resulting in higher overall sound quality. Further, the above embodiments may be easily modified for any combination of mono/stereo downmix input and mono/stereo/binaural output in a stable manner. In accordance with the embodiments, the stereo downmix signal $X^{n,k}$ is taken together with the SAOC parameters, user defined rendering information and an HRTF database as inputs. The transmitted SAOC parameters are $OLD_i^{l,m}$ (object level differences), $IOC_{ij}^{l,m}$ (inter-object cross correlation), $DMG_i^{l,m}$ (downmix gains) and $DCLD_i^{l,m}$ (downmix channel level differences) for all N objects i,j. The HRTF parameters were given as $P_{q,L}^m$, $P_{q,R}^m$ and $\phi_q^m$ for all HRTF database index q, which is associated with a certain spatial sound source position.

Finally, it is noted that although within the above description, the terms "inter-channel coherence" and "inter-object cross correlation" have been constructed differently in that "coherence" is used in one term and "cross correlation" is used in the other, the latter terms may be used interchangeably as a measure for similarity between channels and objects, respectively.

Depending on an actual implementation, the inventive binaural rendering concept can be implemented in hardware or in software. Therefore, the present invention also relates to a computer program, which can be stored on a computer-readable medium such as a CD, a disk, DVD, a memory stick, a memory card or a memory chip. The present invention is, therefore, also a computer program having a program code which, when executed on a computer, performs the inventive method of encoding, converting or decoding described in connection with the above figures.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

Furthermore, it is noted that all steps indicated in the flow diagrams are implemented by respective means in the decoder, respectively, an that the implementations may comprise subroutines running on a CPU, circuit parts of an ASIC or the like. A similar statement is true for the functions of the blocks in the block diagrams In other words, according to an embodiment an apparatus for binaural rendering a multi-channel audio signal 21 into a binaural output signal 24 is provided, the multi-channel audio signal 21 comprising a stereo downmix signal 18 into which a plurality of audio signals $\mathbf{14}_1$-$\mathbf{14}_N$ are downmixed, and side information 20 comprising a downmix information DMG, DCLD indicating, for each audio signal, to what extent the respective audio signal has been mixed into a first channel L0 and a second channel R0 of the stereo downmix signal 18, respectively, as well as object level information OLD of the plurality of audio signals and inter-object cross correlation information IOC describing similarities between pairs of audio signals of the plurality of audio signals, the apparatus comprising means 47 for computing, based on a first rendering prescription $G^{l,m}$ depending on the inter-object cross correlation information, the object level information, the downmix information, rendering information relating each audio signal to a virtual speaker position and HRTF parameters, a preliminary binaural signal 54 from the first and second channels of the stereo downmix signal 18; means 50 for generating a decorrelated signal $X_d^{n,k}$ as an perceptual equivalent to a mono downmix 58 of the first and second channels of the stereo downmix signal 18 being, however, decorrelated to the mono downmix 58; means 52 for computing, depending on a second rendering prescription $P_2^{l,m}$ depending on the inter-object cross correlation information, the object level information, the downmix information, the rendering information and the HRTF parameters, a corrective binaural signal 64 from the decorrelated signal 62; and means 53 for mixing the preliminary binaural signal 54 with the corrective binaural signal 64 to obtain the binaural output signal 24.

References

ISO/IEC JTC 1/SC 29/WG 11 (MPEG), Document N10045, "ISO/IEC CD 23003-2:200x Spatial Audio Object Coding (SAOC)", 85th MPEG Meeting, July 2008, Hannover, Germany EBU Technical recommendation: "MUSHRA-EBU Method for Subjective Listening Tests of Intermediate Audio Quality", Doc. B/AIM022, October 1999.

ISO/IEC 23003-1:2007, Information technology—MPEG audio technologies—Part 1: MPEG Surround ISO/IEC JTC1/SC29/WG11 (MPEG), Document N9099: "Final Spatial Audio Object Coding Evaluation Procedures and Criterion". April 2007, San Jose, USA Jeroen, Breebaart, Christof Faller: Spatial Audio Processing. MPEG Surround and Other Applications. Wiley & Sons, 2007.

Jeroen, Breebaart et al.: Multi-Channel goes Mobile: MPEG Surround Binaural Rendering. AES 29th International Conference, Seoul, Korea, 2006.

The invention claimed is:

1. An apparatus for binaural rendering a multi-channel audio signal into a binaural output signal, the multi-channel audio signal comprising a stereo downmix signal into which a plurality of audio signals are downmixed, and side information comprising a downmix information indicating, for each audio signal, to what extent the respective audio signal has been mixed into a first channel and a second channel of the stereo downmix signal, respectively, as well as object level information of the plurality of audio signals and inter-object cross correlation information describing similarities between pairs of audio signals of the plurality of audio signals, the apparatus being configured to:

compute, based on a first rendering prescription depending on the inter-object cross correlation information, the object level information, the downmix information, rendering information relating each audio signal to a virtual speaker position and HRTF parameters, a preliminary binaural signal from the first and second channels of the stereo downmix signal;

generate a decorrelated signal as a perceptual equivalent to a mono downmix of the first and second channels of the stereo downmix signal, the decorrelated signal being, however, decorrelated from the mono downmix;

compute, depending on a second rendering prescription depending on the inter-object cross correlation information, the object level information, the downmix information, the rendering information and the HRTF parameters, a corrective binaural signal from the decorrelated signal; and mix the preliminary binaural signal with the corrective binaural signal to acquire the binaural output signal.

2. The apparatus according to claim 1, wherein the apparatus is further configured to, in generating the decorrelated signal,sum the first and second channel of the stereo downmix signal and decorrelate the sum to acquire the decorrelated signal.

3. The apparatus according to claim 1 further configured to:

estimate an actual binaural inter-channel coherence value of the preliminary binaural signal;

determine a target binaural inter-channel coherence value; and set a mixing ratio determining to which extent the binaural output signal is influenced by the first and second channels of the stereo downmix signal as processed by the computation of the preliminary binaural signal and the first and second channels of the stereo downmix signal as processed by the generation of a decorrelated signal and the computation of the corrective binaural signal, respectively, based on the actual binaural inter-channel coherence value and the target binaural inter-channel coherence value.

4. The apparatus according to claim 3 wherein the apparatus is further configured to, in setting the mixing ratio, set the mixing ratio by setting the first rendering prescription and the second rendering prescription based on the actual binaural inter-channel coherence value and the target binaural inter-channel coherence value.

5. The apparatus according to claim 3, wherein the apparatus is further configured to, in determining the target binaural inter-channel coherence value, perform the determination based on components of a target covariance matrix F=AEA*, with "*" denoting conjugate transpose, A being a target binaural rendering matrix relating the audio signals to the first and second channels of the binaural output signal, respectively, and being uniquely determined by the rendering information and the HRTF parameters, and E being a matrix being uniquely determined by the inter-object cross correlation information and the object level information.

6. The apparatus according to claim 5, wherein the apparatus is further configured to, in computing the preliminary binaural signal, perform the computation so that $$\hat{X}_1=G\cdot X$$

where X is a 2×1 vector the components of which correspond to the first and second channels of the stereo downmix signal, $\hat{X}_1$ is a 2×1 vector the components of which correspond to the first and second channels of the preliminary binaural signal, G is a first rendering matrix representing the first rendering prescription and comprising a size of 2×2 with $$G=\begin{pmatrix} P_L^1\cos(\beta+\alpha)\exp\left(j\frac{\phi^1}{2}\right) & P_L^2\cos(\beta+\alpha)\exp\left(j\frac{\phi^2}{2}\right) \\ P_R^2\cos(\beta-\alpha)\exp\left(-j\frac{\phi^1}{2}\right) & P_R^2\cos(\beta-\alpha)\exp\left(-j\frac{\phi^2}{2}\right) \end{pmatrix}$$

wherein, with $x\in\{1,2\}$, $$P_L^x=\sqrt{\frac{f_{11}^x}{V^x}},\ P_R^x=\sqrt{\frac{f_{22}^x}{V^x}},$$

$$\phi^x=\begin{cases}\arg(f_{12}^x) & \text{if a first condition applies}\\ 0 & \text{otherwise}\end{cases}$$

wherein $f_{11}^x$, $f_{12}^x$ and $f_{22}^x$ are coefficients of sub-target covariance matrices $F^x$ of size 2×2 with $F^x=A\,E^x\,A^*$, wherein $$e_{ij}^x=e_{ij}\left(\frac{d_i^x}{d_i^1+d_i^2}\right)\left(\frac{d_j^x}{d_i^1+d_i^2}\right)$$

are coefficients of N×N matrix $E^x$, N being the number of audio signals, $e_{ij}$ are coefficients of the matrix E being of size N×N, and $d_i^x$ are uniquely determined by the downmix information, wherein $d_i^1$ indicates the extent to which audio signal i has been mixed into the first channel of the stereo downmix signal and $d_i^2$ defines to what extent audio signal i has been mixed into the second channel of the stereo output signal, wherein $V^x$ is a scalar with $V^x=D^xE(D^x)^*+\epsilon$ and $D^x$ is a 1×N matrix the coefficients of which are $d_i^x$, wherein the apparatus is further configured to, in computing a corrective binaural output signal, perform the computation such that $$\hat{X}_2=P_2\cdot X_d$$

where $X_d$ is the decorrelated signal, $\hat{X}_2$ is a 2×1 vector the components of which correspond to first and second channels of the corrective binaural signal, and $P_2$ is a second rendering matrix representing the second rendering prescription and comprising a size 2×2 with $$P_2=\begin{pmatrix} P_L\sin(\beta+\alpha)\exp\left(j\frac{\arg(c_{12})}{2}\right) \\ P_R\sin(\beta-\alpha)\exp\left(-j\frac{\arg(c_{12})}{2}\right)\end{pmatrix}$$

wherein gains $P_L$ and $P_R$ are defined as $$P_L=\sqrt{\frac{c_{11}}{V}},\ P_R=\sqrt{\frac{c_{22}}{V}}$$

wherein $c_{11}$ and $c_{22}$ are coefficients of a 2×2 covariance matrix C of the preliminary binaural signal with $$C=\tilde{G}DED^*\tilde{G}^*$$

wherein V is a scalar with $V=WEW^*+\epsilon$, W is a mono downmix matrix of size 1×N the coefficients of which are uniquely determined by $d_i^x$, $$D=\begin{pmatrix} D^1 \\ D^2\end{pmatrix},$$

and $\tilde{G}$ is $$\tilde{G}^{l,m}=\begin{pmatrix} P_L^1\exp\left(j\frac{\phi^1}{2}\right) & P_L^{l,m,2}\exp\left(j\frac{\phi^2}{2}\right) \\ P_R^1\exp\left(-j\frac{\phi^1}{2}\right) & P_R^2\exp\left(-j\frac{\phi^2}{2}\right)\end{pmatrix},$$

wherein the apparatus is further configured to, in estimating the actual binaural inter-channel coherence value, determine the actual binaural inter-channel coherence value as $$\rho_C=\min\left(\frac{|c_{12}|}{\sqrt{c_{11}c_{22}}},1\right)$$

wherein the apparatus is further configured to, in determining the target binaural inter-channel coherence value, determine the target binaural inter-channel coherence value as $$\rho_T = \min\left(\frac{|f_{12}|}{\sqrt{f_{11}fl_{22}}}, 1\right),$$

and wherein the apparatus is further configured to, in setting the mixing ratio, determine rotator angles α and β according to $$\alpha = \frac{1}{2}(\arccos(\rho_T) - \arccos(\rho_C)),$$

$$\beta = \arctan\left(\tan(\alpha)\frac{P_R - P_L}{P_L + P_R}\right),$$

with ϵ denoting a small constant for avoiding divisions by zero, respectively.

7. The apparatus according to claim 1, wherein the apparatus is further configured to, in computing the preliminary binaural signal, perform the computation so that $$\hat{X}_1 = G \cdot X$$

where X is a 2×1 vector the components of which correspond to the first and second channels of the stereo downmix signal, $\hat{X}_1$ is a 2×1 vector the components of which correspond to the first and second channels of the preliminary binaural signal, G is a first rendering matrix representing the first rendering prescription and comprising a size of 2×2 with $$G = AED^*(DED^*)^{-1},$$

where E is a matrix being uniquely determined by the inter-object cross correlation information and the object level information;

D is a 2×N matrix the coefficients $d_{ij}$ are uniquely determined by the downmix information, wherein $d_{1j}$ indicates the extent to which audio signal j has been mixed into the first channel of the stereo downmix signal and $d_{2j}$ defines to what extent audio signal j has been mixed into the second channel of the stereo output signal;

A is a target binaural rendering matrix relating the audio signals to the first and second channels of the binaural output signal, respectively, and is uniquely determined by the rendering information and the HRTF parameters, wherein the apparatus is further configured to, in computing a corrective binaural output signal, perform the computation such that $$\hat{X}_2 = P \cdot X_d$$

where $X_d$ is the decorrelated signal, $\hat{X}_2$ is a 2×1 vector the components of which correspond to first and second channels of the corrective binaural signal, and P is a second rendering matrix representing the second rendering prescription and comprising a size 2×2 and is determined such that $PP^* = \Delta R$, with $\Delta R = AEA^* - G_0DED^*G_0^*$ with $G_0 = G$.

8. The apparatus according to claim 1, wherein the apparatus is further configured to, in computing the preliminary binaural signal, perform the computation so that $$\hat{X}_1 = G \cdot X$$

where X is a 2×1 vector the components of which correspond to the first and second channels of the stereo downmix signal, $\hat{X}_1$ is a 2×1 vector the components of which correspond to the first and second channels of the preliminary binaural signal, G is a first rendering matrix representing the first rendering prescription and comprising a size of 2×2 with $$G = (G_0DED^*G_0^*)^{-1}(G_0DED^*G_0^*AEA^*G_0DED^*G_0^*)^{1/2}(G_0DED^*G_0^*)^{-1}G_0 \text{ with } G_0 = AED^*(DED^*)^{-1}$$

where E is a matrix being uniquely determined by the inter-object cross correlation information and the object level information;

D is a 2×N matrix the coefficients $d_{ij}$ are uniquely determined by the downmix information, wherein $d_{1j}$ indicates the extent to which audio signal j has been mixed into the first channel of the stereo downmix signal and $d_{2j}$ defines to what extent audio signal j has been mixed into the second channel of the stereo output signal;

A is a target binaural rendering matrix relating the audio signals to the first and second channels of the binaural output signal, respectively, and is uniquely determined by the rendering information and the HRTF parameters, wherein the apparatus is further configured to, in computing a corrective binaural output signal, perform the computation such that $$\hat{X}_2 = P \cdot X_d$$

where $X_d$ is the decorrelated signal, $\hat{X}_2$ is a 2×1 vector the components of which correspond to first and second channels of the corrective binaural signal, and P is a second rendering matrix representing the second rendering prescription and comprising a size 2×2 and is determined such that $PP^* = (AEA^* - GDED^*G^*)/V$ with V being a scalar.

9. The apparatus according to claim 1, wherein the downmix information is time-dependent, and the object level information and the inter-object cross correlation information are time and frequency dependent.

10. A method for binaural rendering a multi-channel audio signal into a binaural output signal, the multi-channel audio signal comprising a stereo downmix signal into which a plurality of audio signals are downmixed, and side information comprising a downmix information indicating, for each audio signal, to what extent the respective audio signal has been mixed into a first channel and a second channel of the stereo downmix signal, respectively, as well as object level information of the plurality of audio signals and inter-object cross correlation information describing similarities between pairs of audio signals of the plurality of audio signals, the method comprising:

computing, based on a first rendering prescription depending on the inter-object cross correlation information, the object level information, the downmix information, rendering information relating each audio signal to a virtual speaker position and HRTF parameters, a preliminary binaural signal from the first and second channels of the stereo downmix signal;

generating a decorrelated signal as a perceptual equivalent to a mono downmix of the first and second channels of the stereo downmix signal, the decorrelated signal being, however, decorrelated from the mono downmix;

computing, depending on a second rendering prescription depending on the inter-object cross correlation information, the object level information, the downmix information, the rendering information and the HRTF parameters, a corrective binaural signal from the decorrelated signal; and mixing the preliminary binaural signal with the corrective binaural signal to acquire the binaural output signal.

11. A non-transitory computer readable medium including a computer program comprising instructions for performing, when run on a computer, a method for binaural rendering a multi-channel audio signal into a binaural output signal, the multi-channel audio signal comprising a stereo downmix signal into which a plurality of audio signals are downmixed, and side information comprising a downmix information indicating, for each audio signal, to what extent the respective audio signal has been mixed into a first channel and a second channel of the stereo downmix signal, respectively, as well as object level information of the plurality of audio signals and inter-object cross correlation information describing similarities between pairs of audio signals of the plurality of audio signals, the method comprising: computing, based on a first rendering prescription depending on the inter-object cross correlation information, the object level information, the downmix information, rendering information relating each audio signal to a virtual speaker position and HRTF parameters, a preliminary binaural signal from the first and second channels of the stereo downmix signal; generating a decorrelated signal as a perceptual equivalent to a mono downmix of the first and second channels of the stereo downmix signal, the decorrelated signal being, however, decorrelated from the mono downmix; computing, depending on a second rendering prescription depending on the inter-object cross correlation information, the object level information, the downmix information, the rendering information and the HRTF parameters, a corrective binaural signal from the decorrelated signal; and mixing the preliminary binaural signal with the corrective binaural signal to acquire the binaural output signal.

* * * * *